United States Patent [19]

Reap

[11] 4,451,157

[45] May 29, 1984

[54] COMBINED TIME AND TEMPERATURE INDICATING DEVICE

[76] Inventor: James D. Reap, 810 Fowler Ave., Berwick, Pa. 18603

[21] Appl. No.: 377,818

[22] Filed: May 13, 1982

[51] Int. Cl.[3] ..... G04B 47/06

[52] U.S. Cl. ..... 368/11

[58] Field of Search ..... 368/10, 11, 242; 75/356

[56] References Cited

U.S. PATENT DOCUMENTS

| | | | |
|---|---|---|---|
| 3,177,718 | 4/1965 | Stevenson | 368/11 |
| 3,763,647 | 10/1973 | Shibanai | 368/235 |
| 4,163,230 | 7/1979 | Konii | 368/10 |

FOREIGN PATENT DOCUMENTS

| | | | |
|---|---|---|---|
| 2274966 | 9/1976 | France | 368/11 |
| 54-19788 | 2/1979 | Japan | 368/11 |

*Primary Examiner*—Vit W. Miska

*Attorney, Agent, or Firm*—Mawhinney & Mawhinney & Connors

[57] ABSTRACT

A watch dial face is provided with liquid crystal numerals which, in the case of a regular watch face, is located at the twelve positions on the face of the watch. The liquid crystal at these positions range to indicated temperature from minus ten degrees Fahrenheit (−10° F.) to one hundred degrees Fahrenheit (100° F.), and correspond to the numerical value at each position, e.g., one o'clock = 10° F.

Liquid crystals serve a DUAL purpose. Markings on the face of a wristwatch or clock, using liquid crystals, will indicate the *time* by observing the hour and minute hands. Markings on the face of a wristwatch or clock, using liquid crystals, will indicate the temperature by observing color change to any one of the 12 liquid crystal markings. The markings, using liquid crystals, may be of any shape, small or large such as circles, rectangles, squares, dots, and so on.

3 Claims, 3 Drawing Figures

COMBINED TIME AND TEMPERATURE INDICATING DEVICE

BACKGROUND OF THE INVENTION

1. Field of the Invention

The present invention relates to a means for combining a clock with a temperature indicating means. More specifically, the device involves placing a means of indicating the temperature on a watch face. The temperature indicating means are liquid crystal materials and the device is intended to include both indoor wall clocks and wristwatches to show time and temperature.

2. Nature of the Prior Art

A number of devices have been reported in the prior art which combine additional functions with the watch face. U.S. Pat. No. 3,177,718—Time and Temperature Indicating Apparatus—issued to J. A. Stevenson, Apr. 13, 1965 and U.S. Pat. No. 3,763,647—Polychromatic Watch Dial Plate—issued to I. Shibanai, Oct. 3, 1973.

The Stevenson patent describes a temperature indicating means which is actually a circular alcohol thermometer which is visible on a wristwatch face and indicates the temperature by the level of the red colored fluid in the thermometer and the watch face numerals. For example, the temperature of sixty degrees (60°) would correspond with the top edge of the fluid being located at the six o'clock position on the watch face. The device has a means for adjusting the location of the top of the column so it can be positioned opposite the number.

Shibanai involves a dial plate which is made of a polychromatic liquid crystal material whose color is related to a particular temperature. The function of the polychromatic dial is primarily decorative since no temperature indicating is possible with this particular device.

Liquid crystal materials are well-known and are used as the indicating means in various information display devices. The ability to exhibit color is one of the most useful attributes of liquid crystals. Many cholesteric substances behave as liquid crystals only in a certain temperature range. Above the temperature, they are colorless, but as they are cooled through it, they assume a succession of colors from red to violet. Some cholesteric liquid crystals are already colored and change to another color on heating or cooling. Since the exact temperatures at which these color changes occur are invariable, these substances can be used for measuring temperatures and combinations of them cover the range from −20° C. to 250° C. Devices which indicate the temperature using liquid crystals are well-known in the art and are now available in many department stores.

The characteristics of liquid crystals and the way they can be applied to various materials is described in the following publications:

1. Kodak Publication No. JJ14—"Eastman Liquid Crystal Products".
2. Kodak Publication No. JJ-60-723 "Chemistry of Liquid Crystals", by J. P. Van Meter. Eastman Organic Chemical Bulletin, Vol. 45, No. 1 1973.
3. Kodak Publication No. JJ-60-731 "Aspects of Physical Properties and Applications of Liquid Crystals", by S. E. B. Petrie, H. K. Bücker, R. T. Klingbiel and P. I. Rose, Eastman Organic Chemical Bulletin, Vol. 45, No. 2 1973.

BRIEF SUMMARY OF THE INVENTION

The invention is an apparatus for simultaneously indicating time and temperature which comprises a housing with mechanical or electronic time piece means in the housing, a watch face having multiplicity of primary positions thereon for indicating the time and associated with those multiplicity of primary positions, and also, located in the same place as the multiplicity of primary positions are liquid crystal temperature indicating means. The device can be either a wall clock used outdoors, indoors, or a wristwatch. Also within the purview of this invention is a digital wristwatch having liquid crystal indicating means located around the periphery of the watch face.

DETAILED DESCRIPTION OF THE INVENTION

Figure 1:
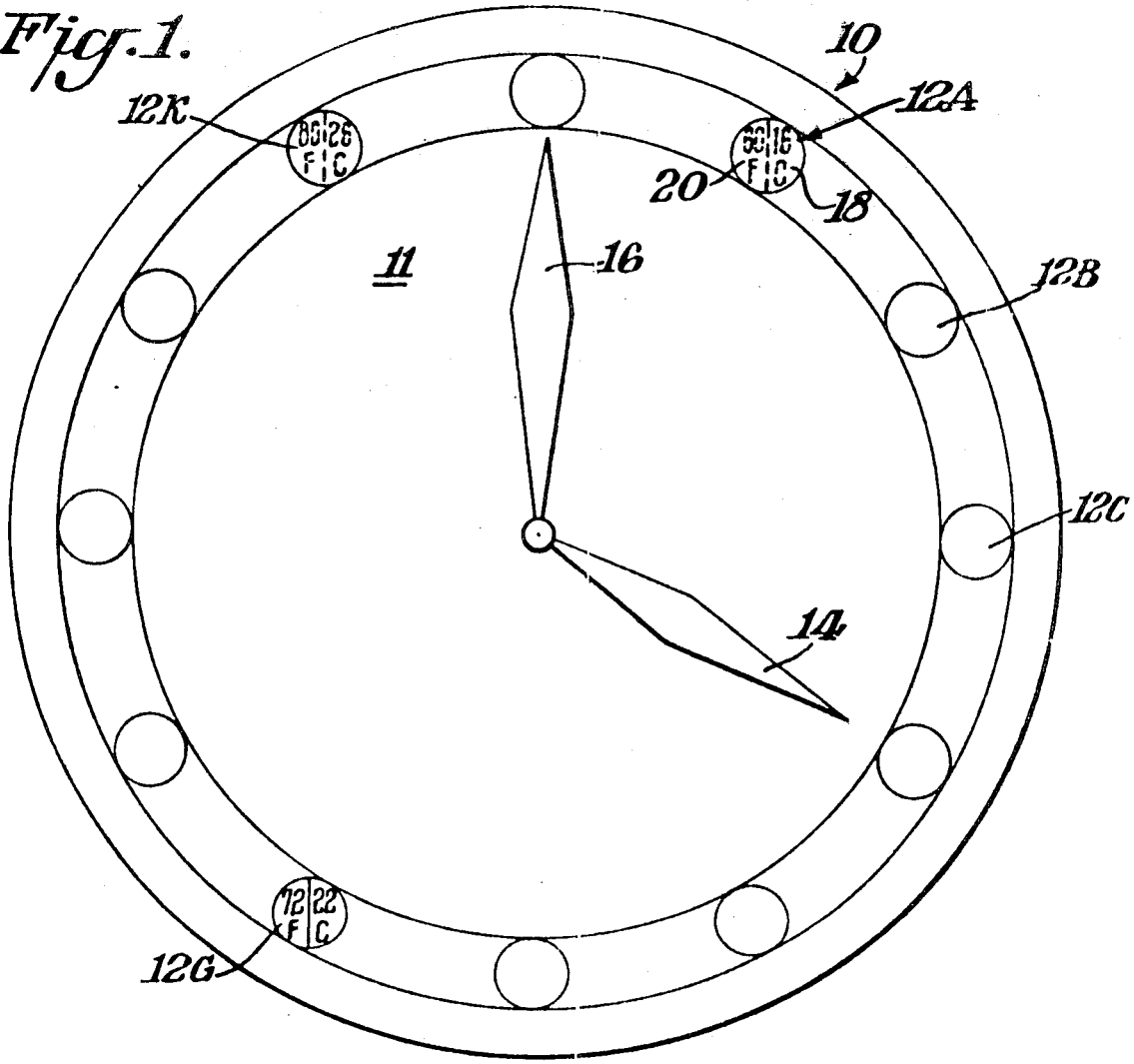
FIG. 1 is a front view of an indoor clock face showing temperature indicating means at the twelve positions where numerals are normally located.

Referring now to the drawing, and beginning with FIG. 1, 10 is a clock with a clock face 11 having time indicating positions 12A, 12B, 12C, 12D, and 12E corresponding to one, two, and three o'clock, minute hand 14, hour hand 16. Each of the positions on the clock face have a liquid crystal temperature indicator half of which shows the temperature in degrees centigrade and the other half in showing the temperature in degrees fahrenheit 20. A number painted 18 on the watch face is revealed when the liquid crystal material melts causing the opaque liquid crystal material to become transparent. One o'clock 12A has the temperature indication of 60° F. or 16° C. shown in broken lines indicating the liquid crystal material is unmelted. At 12G, the temperature of 72° F. or 22° C. is drawn in solid lines to show that the liquid crystal material has melted revealing the numbers at that position. The same drawing of solid lines to indicate melted liquid crystal material is shown at 32I. At 12K, the broken lines show unmelted liquid crystal.

Figure 2:
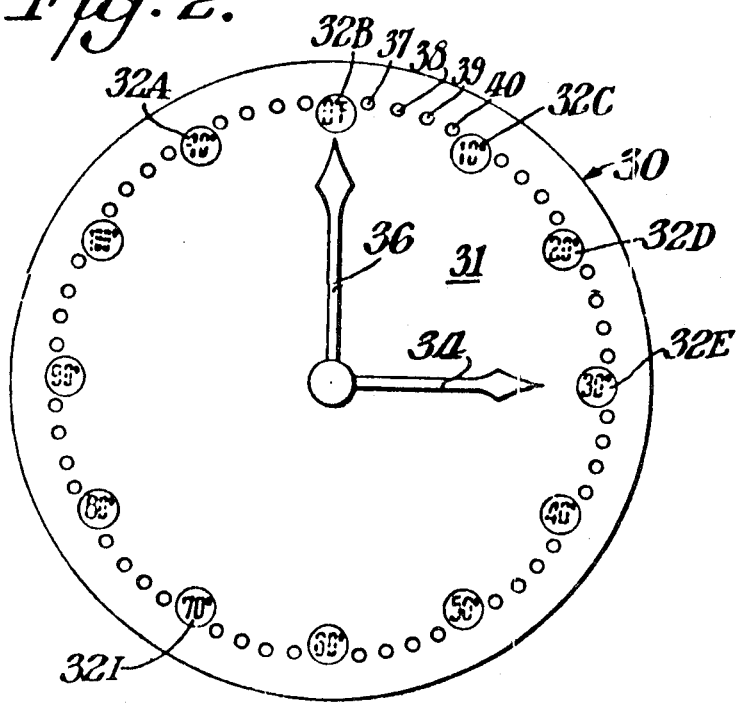
FIG. 2 is a front view of another indoor or outdoor clock face showing temperature indicating means at the numbered positions and also showing intermediate temperature indicators between the numbered positions.

FIG. 2 is another embodiment of the invention showing a clock having a face 31 and time indicating primary positions indicating a twelve hour period, but which are labeled at eleven o'clock through three o'clock (32A–32E). As shown on the clock face 31, at twelve o'clock 32B the temperature is 0° F. and at one o'clock the temperature is 10° F.

While the temperature indicating means located at each hour position on the clock face can be any desired temperature, it is preferred embodiment of this invention that as you proceed clockwise around the face of the clock, the higher temperature is located at each succeeding position. In another preferred embodiment each hour position has a direct numerical relationship to the temperature as indicated below.

Figure 3:
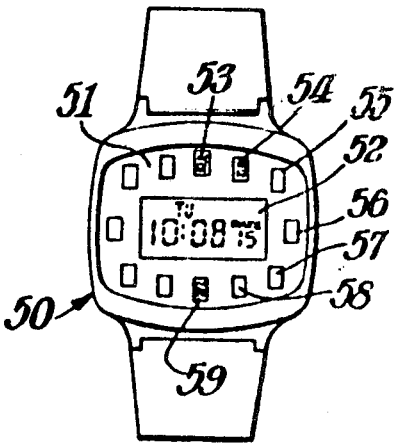
FIG. 3 is a front view of a digital wristwatch showing temperature indicating means around the periphery of the dial face.

FIG. 3 is a digital watch 50 having time and date indicating faces 52. Placed thereon are twelve positions located around the periphery of the face 51. Only the first six positions are labeled 53–59. In the preferred embodiment of this feature, at position 53 would be liquid crystal sensitive to 0° F. with position 54 having liquid crystal sensitive to 10° F.

When the invention is adapted for use on wristwatches, they may be used on digital watches such as that shown in FIG. 3 or it may be used on standard wristwatches having a conventional face such as the face shown in FIG. 2. In either case, the liquid crystals selected for each position must reflect the fact that the watch is heated by the body of the user. This factor is explained further in the following example.

crystal material will change from black to green. Thus, at 3 o'clock, it will be 70° F.

The liquid crystals selected for a particular position on the clock face of a wristwatch are chosen so that an allowance is made for the body temperature of the wearer. The liquid crystal material must compensate for the 98° F. that is the normal body temperature.

Thus, at one o'clock, where the indicated temperature is 10° F., and taking into account the body temperature (98° F.), a liquid crystal melting at 108° F. would be applied to the one o'clock position.

At the two o'clock position, the indicated temperature is 20° F. and a liquid crystal melting at 118° F. would be applied and so on.

TABLE OF LIQUID CRYSTALS AND THEIR USE ON WRISTWATCH

| Clock Position | Wristwatch Indicated Temperature | Melting Temperature of Liquid Crystal Plus Body Heat | *Eastman Organic Chemicals Catalogue No. | Name |
|---|---|---|---|---|
| 1 | 10° F. | 108° F. | A10676 | Cholesteric Mixture |
| 2 | 20° F. | 118° F. | A11270 | " |
| 3 | 30° F. | 128° F. | A9861 | " |
| 4 | 40° F. | 138° F. | A10668 | " |
| 5 | 50° F. | 148° F. | 10598 | Cholesteryl Linoleate |
| 6 | 60° F. | 158° F. | 10434 | Cholesteryl Dodecyl Carbonate |
| 7 | 70° F. | 168° F. | 10434 | Cholesteryl Dodecyl Carbonate |
| 8 | 80° F. | 178° F. | 9841 | Cholesteryl Propargyl Carbonate |
| 9 | 90° F. | 188° F. | 11007 | Cholesteryl 2-Methoxy Ethyl Carbonate |
| 10 | 100° F. | 198° F. | 1007 | Cholesteryl 2-Methoxy Ethyl Carbonate |
| 11 | 110° F. | 208° F. | 11005 | Cholesteryl Furfuryl Carbonate |
| 12 | 0° F. | 98° F. | A10634 | Cholesteric Mixture |

*Eastman Organic Chemicals is a division of Eastman Kodak Company of Rochester, New York.

EXAMPLE I—WRISTWATCH

Each of the twelve time positions on a wristwatch face are blackened with a water soluble black dye. At each of the twelve positions, the liquid crystal material indicated in the table below is sprayed on as a 10 percent solution is petroleum ether. Thus, at the one o'clock position, the number 10 is painted on with black water soluble paint. When the surface is completely dry, the cholesteric mixture A10676 is sprayed over the number 10 at the one o'clock position.

The temperature at the surface of the watch at the one o'clock position would indicate 10° F. by the liquid crystal melting revealing the number 10. In a similar fashion, the other eleven positions on the wristwatch would have the appropriate numbers painted in place with black water soluble paint and the liquid crystal as listed in the following table would be applied to the clock positions indicated.

While the clock embodiments shown on the drawings have numbers at each of the hour positions, it is apparent that the position may be shown by a dot or symbol other than a number. Thus, the liquid crystal material at the 7 o'clock position will change color at about 70° F. and 9 o'clock at 90° F., and both the hour and temperature are provided by reference to the clock face.

Thus, referring to FIGS. 1, 2 and 3, whenever the hour position shown in each figure instead of being numbers can be black liquid material sprayed or silk screened to the watch face. Referring to FIG. 2, when the temperature reaches 70° F. at position 32I, the liquid

EXAMPLE II—WALL MOUNTED CLOCK

Liquid crystals applied to the watch dial face of a mounted clock would record the melting point of the liquid crystal. No compensation is needed.

For example, at the one o'clock position, the indicated temperature is 10° F. and a liquid crystal that melts at 10° F. would be applied. At the two o'clock position, a liquid crystal that melts at 20° F. would be applied and so on.

What I claim is:

1. Combined time and ambient temperature indicating device whereby the temperature, in centrigrade and fahrenheit degrees, for each hour is displayed in visual association with the indication of the hour or part thereof comprising a casing having enclosed therein a clock mechanism and having a watch display face on which hourly time indicator factors are located in a circular visual pattern and in relation to means driven by the clock mechanism and independent liquid crystal temperature indicators placed on said display face at each time indicator factor so that for each hour position the surrounding ambient temperature will be displayed whereby a visual glance at the face to determine the time will enable a person to determine the temperature at such time.

2. The invention of claim 1 wherein the device is a wall clock.

3. The invention of claim 1 wherein the device is a wristwatch.

* * * * *